United States Patent [19]

Stenz

[11] 4,425,018

[45] Jan. 10, 1984

[54] MODULAR ELECTRICAL PLUG AND SOCKET CONNECTORS

[75] Inventor: Paul P. Stenz, Detmold, Fed. Rep. of Germany

[73] Assignee: C.A. Weidmuller GmbH & Co., Detmold, Fed. Rep. of Germany

[21] Appl. No.: 255,086

[22] Filed: Apr. 17, 1981

[30] Foreign Application Priority Data

Apr. 17, 1980 [DE] Fed. Rep. of Germany ..... 3014755

[51] Int. Cl.[3] ..... H01R 9/26

[52] U.S. Cl. ..... 339/198 GA; 339/113 R; 339/198 H; 339/198 P

[58] Field of Search ..... 339/198 G, 198 GA, 198 H, 339/198 S, 198 P, 113 R

[56] References Cited

U.S. PATENT DOCUMENTS

| | | | |
|---|---|---|---|
| 113,982 | 9/1878 | Glaesel | 339/198 GA |
| 2,892,176 | 6/1959 | Gordon | 339/198 G |
| 3,259,870 | 7/1966 | Winkler | 339/198 G |
| 3,377,614 | 4/1968 | Powell et al. | 339/198 GA |
| 3,474,397 | 10/1969 | Piasecki | 339/198 H |
| 3,701,087 | 10/1972 | Bernard | 339/198 G |
| 4,269,470 | 5/1981 | Ustin | 339/198 H |

FOREIGN PATENT DOCUMENTS

| | | | |
|---|---|---|---|
| 1490982 | 10/1969 | Fed. Rep. of Germany | 339/113 R |
| 1938540 | 2/1971 | Fed. Rep. of Germany | 339/198 G |
| 2556336 | 6/1977 | Fed. Rep. of Germany | 339/198 GA |

OTHER PUBLICATIONS

L. C. Garcia & N. K. Powers, Dual-In-Line Basics Building Block Sockets, Jul. 1971.

*Primary Examiner*—Joseph H. McGlynn
*Assistant Examiner*—Paula Austin
*Attorney, Agent, or Firm*—Pollock, Vande Sande & Priddy

[57] ABSTRACT

An electrical connector block comprising plug and/or socket units mechanically coupled together side by side. Each unit has an insulating housing of rectangular cross section. One pair of opposite sides has a dovetail tongue and groove perpendicular to the plugging direction, and the other pair has a dovetail tongue and groove parallel to the said direction. This construction prevents coupled units from being pulled apart when plug and socket blocks are plugged or unplugged.

12 Claims, 6 Drawing Figures

MODULAR ELECTRICAL PLUG AND SOCKET CONNECTORS

This invention relates to electrical plug and socket connectors, assembled from a plurality of individual connector units.

German Published patent application No. 19 23 128 discloses a connector of this nature, in which the individual units are of rectangular cross section and opposite pairs of faces have tongues and grooves. German Published patent application No. 19 52 504 discloses a modular connector in which individual units have grooves on each of the four sides and are coupled by separate tongue elements. In these arrangements, the tongues and grooves extend parallel to the direction of relative movement during the making or breaking of a plug and socket connection. Since the making and breaking of such a connection can involve substantial forces, in particular when a plug block and socket block are separated, these forces may be sufficient to displace individual units, so that in extreme cases separation of the plug and socket blocks causes a unit to be pulled out of its own block while remaining connected to the other block. This risk is particularly serious in environments subject to severe vibration, for example machine shops, where the vibration can itself loosen the coupling between units. This lack of security of individual units is a very serious disadvantage. Hitherto, it has been overcome only by the use of complex and expensive retaining forces. Alternatively, individual units have been provided with fixing means for example screw holes. However, it is then necessary to assure very accurate alignment of the individual units, so that the individual screw holes are in register with one another. This increases the expense of manufacture, because each unit must have such fastening means, and also increases the cost and difficulty of assembling the units into blocks.

The object of the present invention is to provide an electrical connector unit which can be assembled with similar units to form a multi-pole connection block, assuring reliable retention of individual units in the block against separating forces, with a very simple construction.

According to the present invention, there is provided an electrical connector unit adapted to be assembled with at least one further such unit to form a multi-pole electrical plug-and-socket connector block. The unit comprises an insulating housing and electrical contact means in the housing defining a predetermined direction of making a plug-and-socket connection. The housing has a coupling region for mechanically coupling the housing to adjacent units, and the housing has, at least in the coupling region, a rectangular cross section transverse to the said predetermined direction so that said region has a first pair of opposite external faces and a second pair of opposite external faces. The said first pair consists of a first face provided with a first coupling groove extending in said direction and a second face provided with a first coupling tongue extending in said direction and adapted to couple with a said first coupling groove of an adjacent unit, and the second pair of faces consists of a third face provided with a second coupling groove extending transversely to the said direction and a fourth face provided with a second coupling tongue extending transversely to said direction and adapted to couple with a said second coupling groove of an adjacent unit.

When such units are coupled together by means of the tongues and grooves to form a block, each unit, including those at the edges of the block, is retained by at least one tongue and groove coupling transverse to the direction in which forces are applied during plugging and unplugging. Consequently, even if large retaining forces have to be overcome during unplugging, it is impossible for a unit to be pulled out of its block. Furthermore, if a cable connected to such a block is bent close to the block and is subject to a substantial cable pull, individual units cannot be pulled out of the block because they are also retained by grooves and tongues parallel to the plugging and unplugging direction, which will resist the cable pull.

A block composed of units according to the invention can be fixed by very simple additional fixation means, comprising at least one tongue and/or groove corresponding to the tongues and grooves of the connector units. Preferably, for security, the tongues and grooves by which the block is coupled to the fixation means are perpendicular to the direction of plugging and unplugging. This assures that the block will not be pulled away from the retaining means, even if substantial plug-retaining forces have to be overcome during unplugging. The fixation means may, for example, comprise blocks or plates provided with screw holes. An alternative fixation means comprises a base member provided with retaining means for engaging flanges of a channel-section rail, in the manner of the well-known clip-on terminals.

A connector block will in use be provided with only as many fixation means as are necessary for security.

For additional security, cooperating detent means may be provided in the tongues and grooves. For example, each groove may have a detent projection, and each tongue a corresponding recess. This provides extra reliability of coupling, in particular against slow release of the coupling between units in the presence of heavy vibratory loads.

Preferably, plug units and socket units have identical coupling means, so that they can be mixed within a connector block. Such mixing can be used to meet the requirements of a particular installation, or to provide coding within a block to prevent incorrect connection with another block. In particular, a socket unit may be incorporated in a plug block, and the block will then only mate with a socket block containing, in the position corresponding to the socket unit, a plug unit or a gap. It is to be understood that the socket units will normally have housings of which the end faces that mate with plug units are partly or completely closed at the ends, merely allowing entry of a plug pin. Consequently a pair of socket units meeting end to end will prevent engagement of the blocks incorporating them.

The invention will be further described by way of example, with reference to the accompanying drawings, in which.

Figure 1:
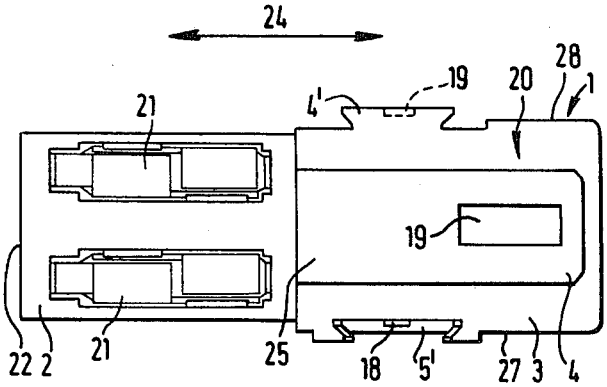
FIG. 1 is a side view of an individual socket unit.
Figure 2:
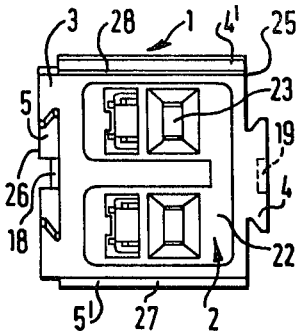
FIG. 2 is a front view of the socket unit.

FIGS. 1 and 2 show a socket unit 1 with an insulating housing 20 comprising a contact region 2 and a coupling region 3. The contact region 3 contains socket contacts 21 and has an end face 22 with apertures 23 giving access to the sockets 21. In use, the region 2 is mated with the contact region of a corresponding plug unit provided with projecting plug pins. The direction of relative movement of the plug and socket units during plugging and unplugging is shown by the arrows 24 in FIG. 1.

At least in the coupling region 3, the insulating housing is of rectangular cross section with a first pair of opposite external surfaces 25, 26 and a second pair of opposite external surfaces 27, 28. In the illustrated embodiment, the coupling region is of square cross-section.

The surfaces 25, 26 have respectively a dovetail tongue 4 and a corresponding dovetail groove 5, parallel to the plugging and unplugging direction 24, i.e., parallel to the longitudinal direction of the contact region 2 and the contact sockets 21.

The other external surfaces 27, 28 have a dovetail tongue 4' and a corresponding dovetail groove 5' oriented perpendicular to the direction 24.

Figure 3:
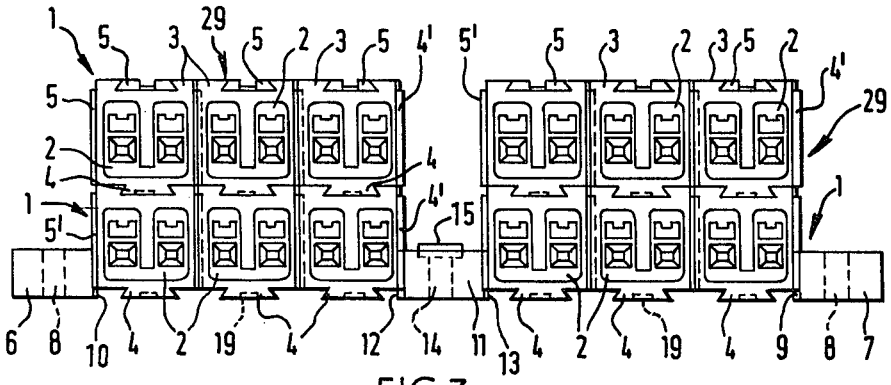
FIG. 3 is a front view of two blocks each of six socket units.

Units of the described kind are coupled together by means of their corresponding tongues and grooves to form socket connector blocks 29 (FIG. 3). In the illustrated blocks, each socket unit is coupled to at least one adjacent unit by a tongue and groove parallel to the direction 24, and to at least one further adjacent unit by a tongue and groove perpendicular to the direction 24. It is therefore not possible for any individual unit to move relative to the rest of the block. Units away from the edges of the block are secured by tongues and grooves transverse to the unplugging direction on two faces. Plug and socket blocks can therefore be separated without destroying the integrity of either block, even if they are subject to high plug-retaining forces within the blocks.

For additional security, each of the dovetail grooves 5, 5' contains a detent projection 18 projecting slightly above the bottom of the groove, and corresponding detent recesses are provided in the surfaces 17, 19 of the corresponding tongues 4, 4'. Thus, when adjacent units are coupled together, their respective detent projections and recesses become engaged to resist separation of the units. This feature is particularly valuable in resisting loosening of the connector block under vibratory loading.

The drawings illustrate a socket unit and socket block. Plug units and and plug blocks can be similarly constructed. Preferably, plug units and socket units have coupling regions 3 which are substantially identical, at least with respect to the external dimensions of these regions, and the dimensions and positions of the tongues and grooves. This facilitates manufacture, and furthermore permits the assembly of mixed connector blocks containing both plug and socket units, either to meet the needs of a particular circuit installation, or to provide coding for particular blocks to assure correct connection of plug and socket blocks.

Figure 5:
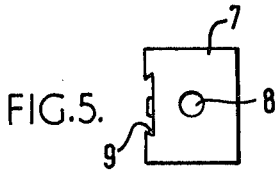
FIGS. 5 and 6 are plan views of fixation elements shown in FIG. 3.
Figure 6:
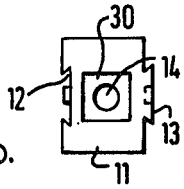

The provision of the transverse dovetail grooves and tongues also permits reliable and simple fixing of a connector block by means of corresponding supplementary fixation elements. FIGS. 3, 5 and 6 show three kinds of fixation elements 6, 7, 11 each in the form of a plate or block with a screw hole 8, 14. The fixation block 6 has, on one side only, a dovetail tongue 10 corresponding to the tongues 4'. The block 7 has in one side a dovetail groove 9 corresponding to the grooves 5', as shown in FIG. 5. These fixation blocks are coupled to external units of a connector block by means of the dovetail tongues and grooves 4', 5' which are perpendicular to the plugging and unplugging direction. They can be applied to plug blocks and socket blocks. In use, they are fitted on to an assembled connector block, and then fastened by screws fitted through the screw holes 8, on to a supporting rail or bar or other supporting surface. The fixation block 11 has a dovetail groove 12 in one side and a dovetail tongue 13 on the opposite side as shown in FIGS. 3 and 6, corresponding to the tongues and grooves 4', 5' of the individual units. It is fitted between adjacent blocks as shown in FIG. 3 and fastened by a screw through the screw hole 14. Alternatively the block 11 can be used to secure an intermediate region of a connector block if necessary. The fixation blocks can have receptacles 30 for marking plates 15, for example to identify particular connector blocks.

Figure 4:
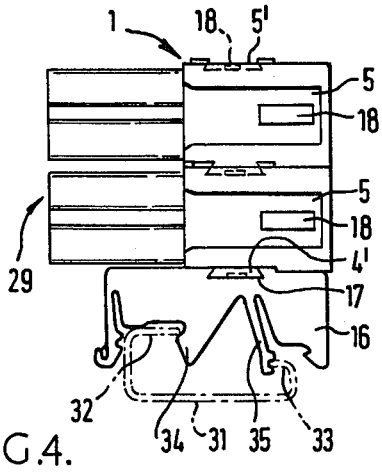
FIG. 4 is a side view of such a block, with a different fixing.

FIG. 4 shows an alternative arrangement in which a socket connector block 29 is mounted, by means of the transverse coupling tongues 4' of one or more individual socket units, on a base member 16 provided with notched and resilient limbs for engaging oppositely directed flanges of a flanged supporting rail 31 of standardized cross section. In the illustrated embodiment the supporting rail has in-turned flanges 32, 33 engaged by a rigid notched limb 34 and a resilient notched limb 35 of the base member 16.

It will be understood that it is not necessary to provide every unit of the connector block with fixation means. The number and position of fixation means can be selected according to the requirements of the particular installation.

I claim:

1. An electrical connector unit adapted to be assembled with at least one further such unit to form a multipole electrical plug-and-socket connector block, which unit comprises (a) an insulating housing; and (b) electrical contact means in said housing defining a predetermined direction of making a plug-and-socket connection;

(c) said housing having a coupling region for mechanically coupling said housing to adjacent units, said housing having at least in said coupling region a rectangular cross section transverse to said predetermined direction, whereby said region has a first pair of opposite external faces and a second pair of opposite external faces, said first pair consisting of a first face provided with a first coupling groove having its longitudinal axis extending in said predetermined direction and a second face provided with a first coupling tongue having its longitudinal axis extending in said predetermined direction and adapted to couple with a said first coupling groove of an adjacent unit by relative sliding movement of said units parallel to said predetermined direction, and said second pair of faces consisting of a third face provided with a second coupling groove having its longitudinal axis extending transversely to said predetermined direction and a fourth face provided with a second coupling tongue having its longitudinal axis extending transversely to said predetermined direction and adapted to couple with a said second coupling groove of an adjacent unit by relative sliding movement of said units transversely to said predetermined direction parallel to said third and fourth faces thereof.

2. A connector unit as claimed in claim 1, wherein said tongues and grooves are of dovetail cross section.

3. A connector unit as claimed in claim 1, wherein each groove contains a detent projection and each tongue contains a detent recess corresponding to the detent projection in the corresponding groove.

4. A multi-pole electrical plug-and-socket connector block comprising in combination a plurality of connector units according to claim 1, mechanically coupled together by their respective coupling tongues engaged in corresponding respective coupling grooves.

5. A connector block as claimed in claim 4, wherein at least one connector unit has electrical plug contact means and at least one connector unit has socket contact means.

6. A connector block as claimed in claim 4, in combination with at least one fixation member provided with at least one groove corresponding to a said tongue of a said unit.

7. A connector block as claimed in claim 4, in combination with at least one fixation member provided with at least one tongue corresponding to a said groove of a said unit.

8. A connector block as claimed in claim 7 wherein said fixation member is a base member provided with retaining means adapted to engage in use flanges of a channel-section rail having oppositely directed flanges.

9. A connector block as claimed in claim 7, wherein said fixation member or members are coupled to the block by tongues and grooves extending transversely to said predetermined direction.

10. A connector block as claimed in claim 7, wherein at least one fixation member has (a) a screw hole for receiving a fixing screw, (b) a first side provided with a tongue for engagement with a said groove of a said unit, and (c) an opposite side provided with a groove for engagement with a said tongue of a said unit.

11. A connector block as claimed in claim 7, wherein at least one fixation member is provided with only one of said tongue and groove and has a hole for a fixing screw.

12. A connector block as claimed in claim 10 or 11, wherein said fixation member provided with a screw hole is also provided with means for receiving a symbol carrier.

* * * * *